US007316282B2

(12) United States Patent
Mulhern et al.

(10) Patent No.: US 7,316,282 B2
(45) Date of Patent: Jan. 8, 2008

(54) ANTI-TIP SYSTEM FOR WHEELCHAIRS

(75) Inventors: James P. Mulhern, Nanticoke, PA (US); Ronald Levi, Courtdale, PA (US)

(73) Assignee: Pride Mobility Products Corporation PA (US)

( * ) Notice: Subject to any disclaimer, the term of this patent is extended or adjusted under 35 U.S.C. 154(b) by 91 days.

(21) Appl. No.: 10/961,972

(22) Filed: Oct. 8, 2004

(65) Prior Publication Data

US 2005/0077714 A1 Apr. 14, 2005

Related U.S. Application Data

(60) Provisional application No. 60/552,227, filed on Mar. 11, 2004, provisional application No. 60/509,502, filed on Oct. 8, 2003.

(51) Int. Cl.
*A61G 5/04* (2006.01)

(52) U.S. Cl. ..... 180/65.1; 280/304.1; 280/250.1; 180/907

(58) Field of Classification Search ..... 280/47.38, 280/304.1, 250.1, 755, 124.164; 180/65.1, 180/907; 297/DIG. 4
See application file for complete search history.

(56) References Cited

U.S. PATENT DOCUMENTS

| | | | | |
|---|---|---|---|---|
| 2,427,482 A * | 9/1947 | Weissman | ..... | 280/5.2 |
| 3,104,112 A | 9/1963 | Crail | ..... | 280/5.2 |
| 3,520,378 A | 7/1970 | Slay | ..... | 180/21 |
| 3,827,718 A | 8/1974 | Curry | | |
| 4,000,912 A | 1/1977 | Donald et al. | | |
| 4,128,137 A | 12/1978 | Booth | ..... | 180/6.5 |
| 4,245,847 A | 1/1981 | Knott | ..... | 280/5.2 |
| 5,435,404 A | 7/1995 | Garin, III | ..... | 180/6.5 |
| 5,564,512 A | 10/1996 | Scheulderman | ..... | 180/65.5 |
| 5,772,237 A | 6/1998 | Finch et al. | ..... | 280/704 |
| 5,848,658 A | 12/1998 | Pulver | ..... | 180/65.1 |
| 5,855,387 A | 1/1999 | Gill et al. | ..... | 280/283 |
| 5,964,473 A | 10/1999 | Degonda et al. | ..... | 280/250.1 |
| 6,047,979 A | 4/2000 | Kraft et al. | ..... | 280/250.1 |

(Continued)

FOREIGN PATENT DOCUMENTS

EP 1 493 418 2/2005

(Continued)

OTHER PUBLICATIONS

Photographs—Sunrise Medical G-424 (sold from Oct. 1999).

*Primary Examiner*—Christopher Bottorff
(74) *Attorney, Agent, or Firm*—DLA Piper US LLP

(57) ABSTRACT

An anti-tip system is adapted for use in a powered wheelchair for purposes of curb-climbing and ride stability. The anti-tip system includes at least one anti-tip wheel, a suspension arm for mounting the anti-tip wheel and a pair of links coupling the suspension arm to the main structural frame of the wheelchair. Each of the links is pivotally mounted to the main structural frame of the wheelchair about a first pivot point and is pivotally mounted to the suspension arm about a second pivot point. In a first embodiment of the anti-tip system, the links include an upper and lower link, wherein the upper link is extensible to facilitate angular displacement of the suspension arm to permit rearward displacement of the anti-tip wheel in response to an externally applied load.

43 Claims, 8 Drawing Sheets

U.S. PATENT DOCUMENTS

| | | | | |
|---|---|---|---|---|
| 6,129,165 | A | 10/2000 | Schaffner et al. | 180/65.1 |
| 6,131,679 | A * | 10/2000 | Pulver et al. | 180/65.1 |
| 6,131,940 | A * | 10/2000 | Arnoth | 280/650 |
| 6,196,343 | B1 | 3/2001 | Strautnieks | 180/22 |
| 6,234,507 | B1 | 5/2001 | Dickie et al. | 280/304.1 |
| 6,341,657 | B1 | 1/2002 | Hopely et al. | |
| 6,357,793 | B1 | 3/2002 | Dickie et al. | 280/755 |
| 6,460,641 | B1 | 10/2002 | Kral | 180/24.02 |
| 6,533,306 | B2 | 3/2003 | Watkins | 280/340.1 |
| 6,543,798 | B2 | 4/2003 | Schaffner et al. | 280/250.1 |
| 6,554,086 | B1 | 4/2003 | Goertzen et al. | 180/65.1 |
| 6,705,629 | B2 | 3/2004 | Post et al. | 280/250.1 |
| 6,752,230 | B1 | 6/2004 | Huang | 180/209 |
| 6,796,568 | B2 | 9/2004 | Martis et al. | |
| 6,851,711 | B2 | 2/2005 | Goertzen et al. | 280/755 |
| 6,923,278 | B2 | 8/2005 | Mulhern et al. | |
| 7,021,641 | B2 * | 4/2006 | Wu | 280/250.1 |
| 7,040,429 | B2 * | 5/2006 | Molnar | 180/65.1 |
| 7,100,718 | B2 * | 9/2006 | Bancroft | 180/65.1 |
| 7,104,346 | B2 | 9/2006 | Schaffner | 180/65.1 |
| 2003/0075365 | A1 | 4/2003 | Fought | 180/6.5 |
| 2004/0004342 | A1 | 1/2004 | Mulhern et al. | 280/304.1 |
| 2004/0035627 | A1 | 2/2004 | Richey et al. | 180/210 |
| 2004/0046358 | A1 | 3/2004 | White et al. | 280/304.1 |
| 2004/0060748 | A1 | 4/2004 | Molnar | 180/65.1 |
| 2004/0168839 | A1 * | 9/2004 | Wu | 180/65.1 |
| 2004/0251649 | A1 | 12/2004 | Wu | 280/86.1 |
| 2004/0262859 | A1 | 12/2004 | Tuturiello et al. | |
| 2005/0000742 | A1 | 1/2005 | Mulhern et al. | |
| 2005/0127631 | A1 | 6/2005 | Schaffner | 280/124.1 |
| 2005/0206149 | A1 | 9/2005 | Mulhern et al. | |
| 2006/0022445 | A1 | 2/2006 | Mulhern et al. | |

FOREIGN PATENT DOCUMENTS

| | | |
|---|---|---|
| FR | 2215054 | 8/1974 |
| FR | 2215054 | 3/1979 |
| FR | 2399822 | 3/1979 |
| GB | 2 051 702 | 5/1980 |
| GB | 2192595 | 1/1988 |
| JP | 2001104391 | 4/2001 |
| WO | 87/06205 | 4/1987 |
| WO | 90/06097 | 11/1989 |
| WO | WO 00/54718 | 9/2000 |
| WO | WO 02/34190 | 5/2002 |
| WO | WO 03/030800 | 4/2003 |

* cited by examiner

ANTI-TIP SYSTEM FOR WHEELCHAIRS

RELATED APPLICATIONS

The present application relates to and claims the benefit of the filing of U.S. Provisional Application No. 60/509,502, filed Oct. 8, 2003, and U.S. Provisional Application No. 60/552,227, filed Mar. 11, 2004; said applications being herein incorporated by reference.

TECHNICAL FIELD

The present invention relates to anti-tip systems for wheelchairs, and, more particularly, to a new and useful anti-tip system for providing improved obstacle-climbing capability.

BACKGROUND OF THE INVENTION

Self-propelled or powered wheelchairs have vastly improved the mobility/transportability of the disabled and/or handicapped. Whereas in the past disabled/handicapped individuals were nearly entirely reliant upon the assistance of others for transportation, the Americans with Disabilities Act (ADA) of June 1990 has effected sweeping changes to provide equal access and freedom of movement/mobility for disabled individuals. Notably, various structural changes have been mandated to the construction of homes, offices, entrances, sidewalks, and even parkway/river crossings, e.g., bridges, to include enlarged entrances, powered doorways, entrance ramps, curb ramps, etc., to ease mobility for disabled persons in and around society.

Along with these societal changes, it has become possible to offer better, more agile, longer-running and/or more stable powered wheelchairs to take full advantage of the new freedoms imbued by the ADA. More specifically, various technologies, initially developed for the automobile and aircraft industries, are being successfully applied to powered wheelchairs to enhance the ease of control, improve stability, and/or reduce wheelchair weight and bulk. For example, sidearm controllers, i.e., multi-axis joysticks, employed in high technology VTOL and fighter aircraft, are being utilized for controlling the speed and direction of powered wheelchairs. Innovations made in the design of automobile suspension systems, e.g., active suspension systems, which vary spring stiffness to vary ride efficacy, have also been adapted to wheelchairs to improve and stabilize powered wheelchairs. Other examples include the use of high-strength fiber reinforced composites, e.g. graphite, fiberglass, etc. to improve the strength of the wheelchair frame while reducing weight and bulk.

One particular system which has gained widespread popularity/acceptance is the mid-wheel drive powered wheelchair, and more particularly such powered wheelchairs with anti-tip systems. Mid-wheel drive powered wheelchairs generally have a pair of drive wheels with a common rotational axis positioned slightly forward of the combined center of gravity of the occupant and wheelchair to provide enhanced mobility and maneuverability. Anti-tip systems provide enhanced stability of the wheelchair about its pitch axis and, in some of the more sophisticated anti-tip designs, improve the obstacle or curb-climbing ability of the wheelchair. Such mid-wheel powered wheelchairs and/or powered wheelchairs having anti-tip systems are disclosed in Schaffner et al. U.S. Pat. Nos. 5,944,131 & 6,129,165, both issued and assigned to Pride Mobility Products Corporation located in Exeter, Pa.

While such wheelchair designs have vastly improved the capability and stability of powered wheelchairs, designers thereof are continually being challenged to examine and improve wheelchair design and construction. For example, the Schaffner '131 patent discloses a mid-wheel drive wheelchair having a passive anti-tip system. That passive anti-tip system functions principally to prevent forward tipping of the wheelchair. The anti-tip wheel in the Schaffner '131 patent is pivotally mounted to a vertical frame support about a pivot point which lies above the rotational axis of the anti-tip wheel. Because of the geometry of the passive anti-tip system, the anti-tip wheel must contact a curb or other obstacle at a point below its rotational axis to cause the wheel to "kick" upwardly and climb over the obstacle. Consequently, this geometric relationship limits the curb-climbing ability of the wheelchair.

The Schaffner '165 patent discloses a mid-wheel drive powered wheelchair having an anti-tip system which is "active" in contrast to the passive system discussed previously and disclosed in the '131 patent. That active anti-tip system is responsive to torque applied by the drive motor, or pitch motion of the wheelchair frame about its effective pitch axis, to vary the position of the anti-tip wheels actively, thereby improving the wheelchair's ability to climb curbs or overcome obstacles. More specifically, the active anti-tip system of the Schaffner '165 patent mechanically couples the suspension system of the anti-tip wheel to the drive train assembly such that the anti-tip wheels displace upwardly or downwardly as a function of the magnitude of: (i) torque applied by the drive train assembly, (ii) angular acceleration of the frame or (iii) pitch motion of the frame relative to the drive wheels.

FIG. 1 is a schematic view of a power wheelchair with an active anti-tip system 110 similar to that disclosed in the Schaffner '165 patent. The drive train and suspension systems shown in FIG. 1 are mechanically coupled by a longitudinal suspension arm 124, pivotally mounted to the main structural frame 103 about a pivot point 108. A drive train assembly 107 is mounted at one end of the suspension arm 110, and an anti-tip wheel 116 is mounted at the other end, at the front of the wheelchair. In operation, torque from a drive wheel 106 is reacted by the main structural frame 103, resulting in relative rotational displacement between the drive train assembly 107 and the frame 103. The relative motion therebetween, in turn, effects rotation of the suspension arm 124 about its pivot axis 108 in a clockwise or counterclockwise direction depending upon the direction of the applied torque. That is, upon a forward acceleration, or increased torque input (as may be required to overcome or climb an obstacle), counterclockwise rotation of the drive train assembly 107 as seen in FIG. 1 (from the side of the wheelchair that is to the user's right) will occur, effecting upward displacement of the anti-tip wheel 116. Consequently, the anti-tip wheels 116 are "actively" lifted or raised to facilitate operational modes such as curb climbing. Alternatively, deceleration causes a clockwise rotation of the drive train assembly 107 as seen in FIG. 1, thus effecting a downward displacement of the respective anti-tip wheel 116. The downward motion of the anti-tip wheel 116 also assists to stabilize the wheelchair when going down a slope. Here again, the anti-tip system "actively" responds to a change in applied torque to vary the position of the anti-tip wheel 116.

While the active anti-tip system disclosed in the Schaffner patent '165 offers significant advances by comparison to prior art passive systems, the one piece construction of the suspension arm 124, with its single pivot connection 108, necessarily requires that both the drive train assembly 107 and the anti-tip wheel 116 move through the same angle about the pivot 108, relative to the frame 103. As a result, the arc length or up or down displacement of the anti-tip wheel 116 is limited by the angle through which the drive train assembly 107 moves. The single pivot mount design, while elegant and simple, thus limits the freedom available for the designer to satisfy other requirements.

Moreover, when the anti-tip wheel 116 contacts a vertical curb or obstacle at or near a point which is in-line with the wheel's rotational axis, the point of contact is below the pivot connection 108. That will produce a force couple rotating the suspension arm 124 downwardly, so the anti-tip wheel 116 will also tend to move downwardly. This downward travel is, of course, contrary to a desired upward motion for climbing curbs and/or other obstacles.

Other wheelchair anti-tip systems exist, such as the one illustrated and described in published International Patent Application No. WO 03/030800 A1 assigned to Invacare Corporation. This suspension/anti-tip system employs an arrangement of links. The anti tip wheel moves up and down because the anti tip wheel is mounted on the front end of a fore-and-aft suspension arm carrying the motors and drive wheels. In addition, the anti tip wheel swings rearwardly and upwardly about the front end of the suspension arm when the front end of the suspension arm rises, and vice versa.

SUMMARY OF THE INVENTION

In one embodiment of the invention, an anti-tip system is adapted for use in a powered wheelchair for improving the curb-climbing ability of a powered wheelchair. The anti-tip system includes at least one anti-tip wheel, a suspension arm for mounting the anti-tip wheel, and a pair of links for coupling the suspension arm to the main structural frame of the wheelchair. Each of the links is pivotally mounted to the main structural frame of the wheelchair about a first pivot point and is pivotally mounted to the suspension arm about a second pivot point. At least one of the links is variable in length to facilitate angular displacement of the suspension arm to effect longitudinal motion of the anti-tip wheel.

In another embodiment of the invention, an anti-tip system is adapted for use in a powered wheelchair for improving the curb-climbing ability of a powered wheelchair and enhancing the stability of the powered wheelchair about a pitch axis. The powered wheelchair includes a drive train assembly pivotally mounted to a main structural frame of the wheelchair and may include a suspension system for biasing the drive train assembly and/or an anti-tip system to a predetermined resting position. The drive train assembly rotates about the pivot axis in response to torque applied by the drive motor during operation of the wheelchair. The "kneeling" anti-tip system has a suspension arm for mounting the anti-tip wheel about a rotational axis. A pair of links are pivotally mounted to the wheelchair main frame and to the suspension arm. At least one of the links is caused to rotate in response to torque applied by the drive motor through a third link, thereby causing the suspension arm to move up and down and rotate to effect vertical and longitudinal displacement of the anti-tip wheel. Preferably, the anti-tip wheel is a front wheel and moves rearwardly and unrearwardly upon acceleration for climbing curbs, and displaces forwardly and downwardly, upon deceleration for pitch stabilization.

BRIEF DESCRIPTION OF THE DRAWINGS

For the purpose of illustrating the invention, there are shown in the drawings various forms that are presently preferred; it being understood, however, that this invention is not limited to the precise arrangements and constructions particularly shown.

DETAILED DESCRIPTION OF THE DRAWINGS

Figure 1:
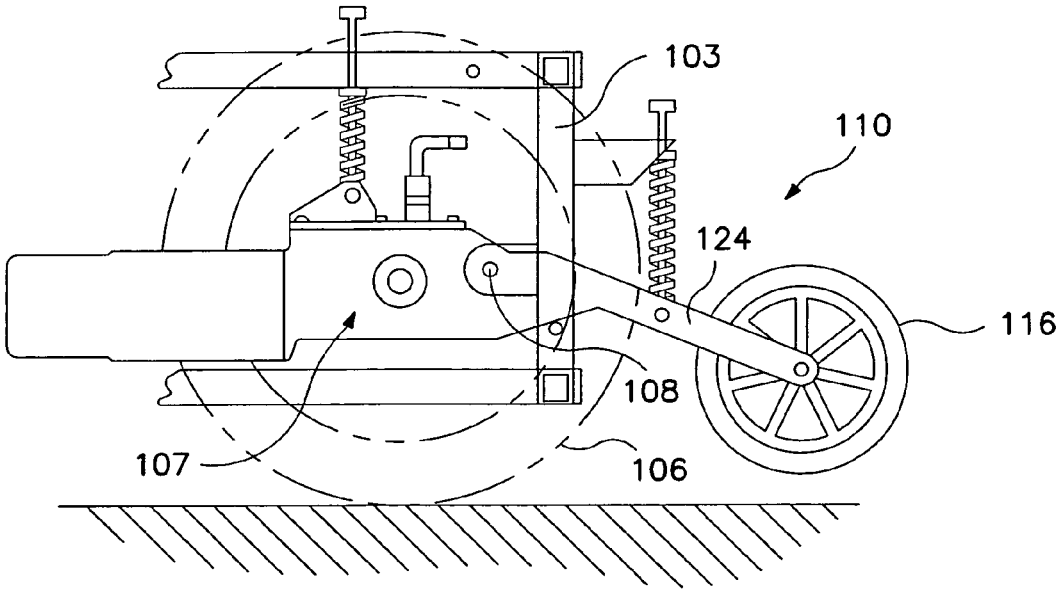
FIG. 1 PRIOR ART
FIG. 1 is a schematic view of a prior art active anti-tip system for use in powered wheelchairs.
Figure 2A:
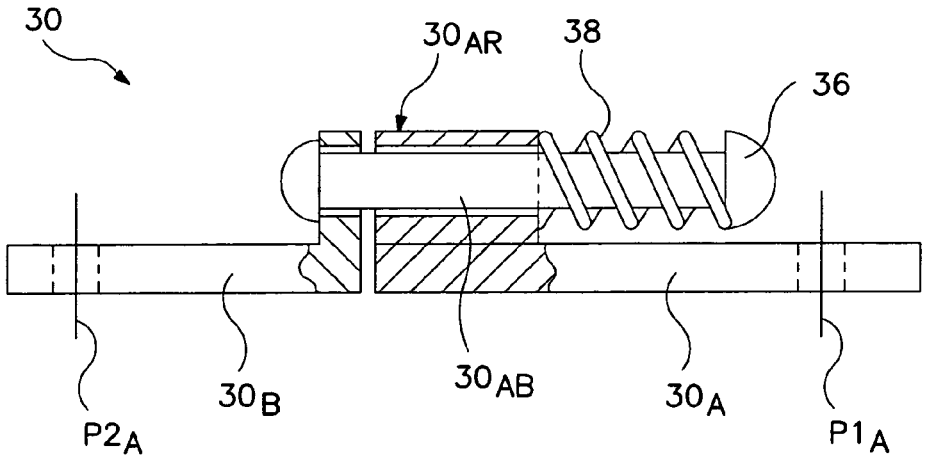
FIG. 2*a* is an isolated top view of an extensible link for use in the adaptable anti-tip system of FIG. 2.
Figure 2:
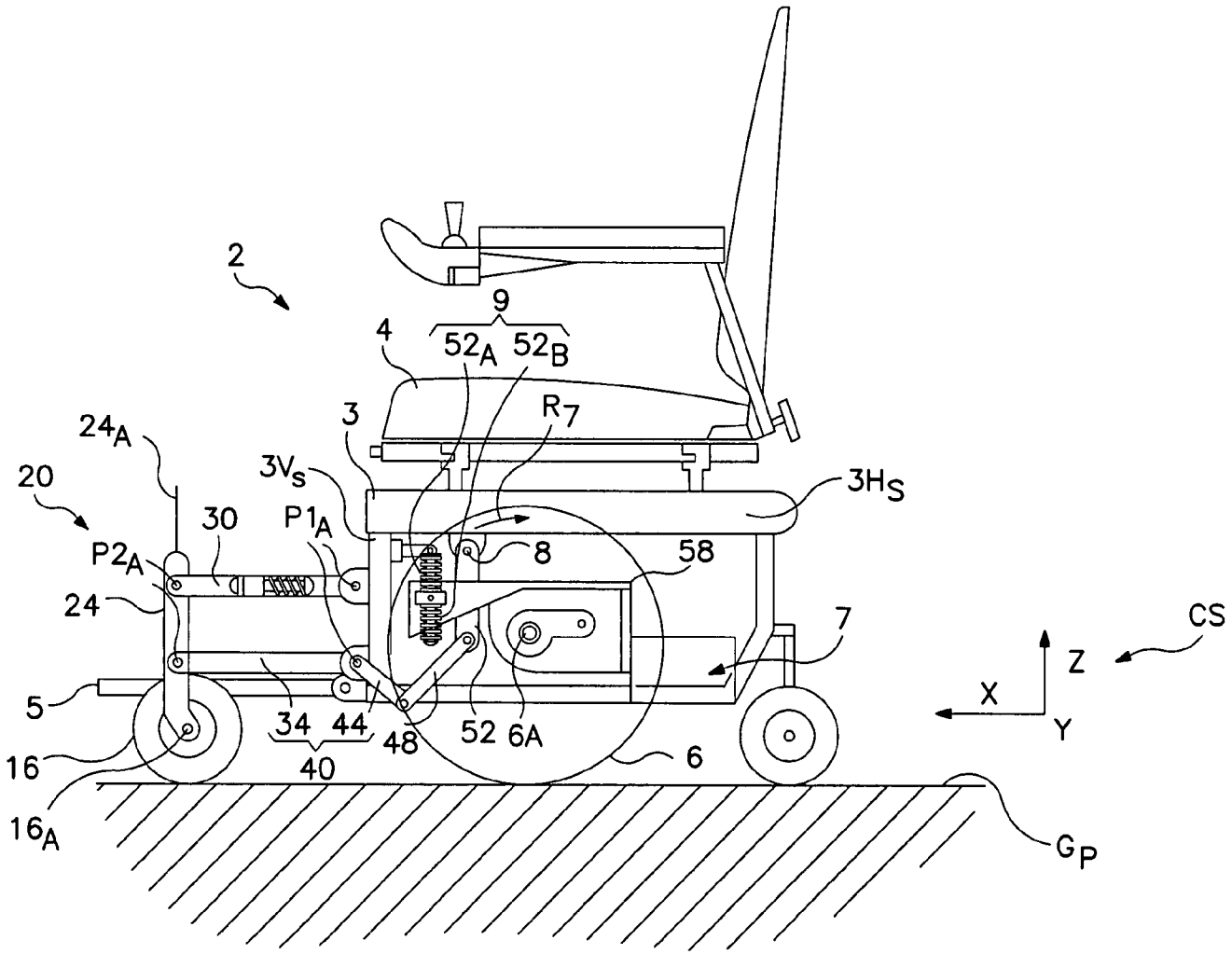
FIG. 2 is a somewhat schematic side view of a first embodiment of a powered wheelchair having one of its drive-wheels removed, showing an adaptable anti-tip system according to a first embodiment of the present invention.

Referring now to FIGS. 2 to 5 of the drawings, wherein like reference numerals identify like elements, components, subassemblies etc., and initially to FIG. 2, a first embodiment of a powered wheelchair, indicated generally by the reference numeral 2, includes an adaptable active anti-tip system indicated generally by the reference numeral 20 according to a first embodiment of the present invention. In the embodiment shown in FIGS. 2 to 5, the powered wheelchair 2 includes a main structural frame on body 3, a seat 4 for supporting a wheelchair occupant (not shown), a footrest assembly 5 for supporting the feet and legs (also not shown) of the occupant while the occupant is operating the wheelchair 2, and a pair of drive wheels 6 (shown schematically in the figure) each being independently controlled and driven by a drive train assembly 7. Each drive train assembly 7 is pivotally mounted to the main structural frame 3 about a pivot point 8 to effect relative rotation therebetween in response to torque applied by the drive motor or pitch motion of the frame about an effective pitch axis (not shown). Further, a suspension assembly 9 is provided for biasing the anti-tip system 20 to a predetermined operating position and determines the effective pitch axis of the frame.

To facilitate the description it will be useful to define a coordinate system as a point of reference for certain described geometric relationships including the direction and/or angular orientation of the various anti-tip system components. FIG. 2 also shows a Cartesian coordinate system CS wherein the X-Y plane is coplanar with a ground plane Gp upon which the wheelchair rests, and runs from right to left in FIG. 2. The X-axis is parallel to the direction of wheelchair forward motion and is referred to as the "longitudinal" direction. The Y-axis is parallel to the rotational axis 6A of the drive wheels 6, and runs perpendicular to the plane of the paper in FIG. 2, and is referred to as the "lateral" direction. The Z-axis is normal to the X-Y plane (or to the ground plane GP), and runs up and down in FIG. 2, and is referred to as the "vertical" direction.

The anti-tip system 20 includes a suspension arm 24 for mounting an anti-tip wheel 16. The suspension arm has a longitudinal axis $\mathbf{24}_A$ which, in the rest position of the wheelchair on level ground with the forces suspending the anti-tip wheel 16 are in equilibrium, as shown in FIG. 2, is substantially vertical relative to the ground plane $G_P$. As used herein, "substantially vertical" means that the longitudinal axis $\mathbf{24}_A$ is about ±20 degrees relative to the Z axis of the coordinate system CS. The axis of rotation $\mathbf{16}_A$ of the anti-tip wheel 16 may be fixed or castored relative to the suspension arm 24, and the suspension arm 24 may include bearings (not shown) for enabling rotation of a castored anti-tip wheel 16 about the vertical Z axis. Castoring of the anti-tip wheel 16 may facilitate heading or directional changes.

A pair of links 30, 34 are each pivotally mounted about a respective first axis $P\mathbf{1}_A$ to the wheelchair main frame 3 and pivotally mounted about a respective second pivot axis $P\mathbf{2}_A$ to the vertical suspension arm 24.

In the wheelchair 2 shown in FIGS. 2 to 5, in the rest position the links 30, 34 are substantially parallel. At least one of the links, link 30 as shown in the drawings, is variable in length during wheelchair operation. The significance of such length variation will be discussed in greater detail when describing the operational modes of the wheelchair 2. Furthermore, in the described embodiment, at least one of the links 30, 34 is caused to rotate in response to torque applied by the drive train assembly 7. That is, a mechanism is provided to transfer the bi-directional rotational motion of the drive train assembly 7 about the pivot point 8 to one of the links 30, 34. Alternatively, the links 30, 34 may rotate as a consequence of the pitching motion of the wheelchair frame 3 caused, for example, by inertial forces acting on the wheelchair 2 in the course of an acceleration or deceleration.

Referring now especially to FIGS. 2 and 2*a*, the upper link 30 is extensible and includes first and second link segments $\mathbf{30}_A$, $\mathbf{30}_B$ connected by a spring-biased tension rod 36. The first link segment $\mathbf{30}_A$ includes a rod connecting end $\mathbf{30}_{AR}$ having a longitudinal bore $\mathbf{30}_{AB}$ for accepting and aligning the tension rod 36. A coil spring 38 envelops a portion of the tension rod 36 and is disposed between the rod connecting end $\mathbf{30}_{AR}$ of the first link segment $\mathbf{30}_A$ and a head forming a first end of the tension rod 36, being the end further from the second link segment $\mathbf{30}_B$. The second link segment $\mathbf{30}_B$ is longitudinally aligned with the first link segment $\mathbf{30}_A$ and includes an L-bracket for connecting to the second end of the tension rod 36. In the rest position, the L-bracket on the second link segment $\mathbf{30}_B$ abuts the rod connecting end $\mathbf{30}_{AR}$ of the first link segment $\mathbf{30}_A$. The coil spring 38 is preloaded in compression between the rod connecting end $\mathbf{30}_{AR}$ and the first end of the tension rod 36. The tension rod 36 is in tension between its first and second ends. The second end of the tension rod 36 presses on the L-bracket on the second link segment $\mathbf{30}_B$. Thus, the first and second link segments are held aligned by the tension rod 36 and are held together by the force in the spring 38. The first and second link segments $\mathbf{30}_A$, $\mathbf{30}_B$ may move apart, extending the link 30 longitudinally, by the telescoping motion of the tension rod 36 within the longitudinal bore $\mathbf{30}_{AB}$ and compression of the coil spring 38. The coil spring 38 exerts a restoring force contracting the link 30 to the rest position where the link segments $\mathbf{30}_A$, $\mathbf{30}_B$ abut and prevent further shortening.

Figures 3, 3A:
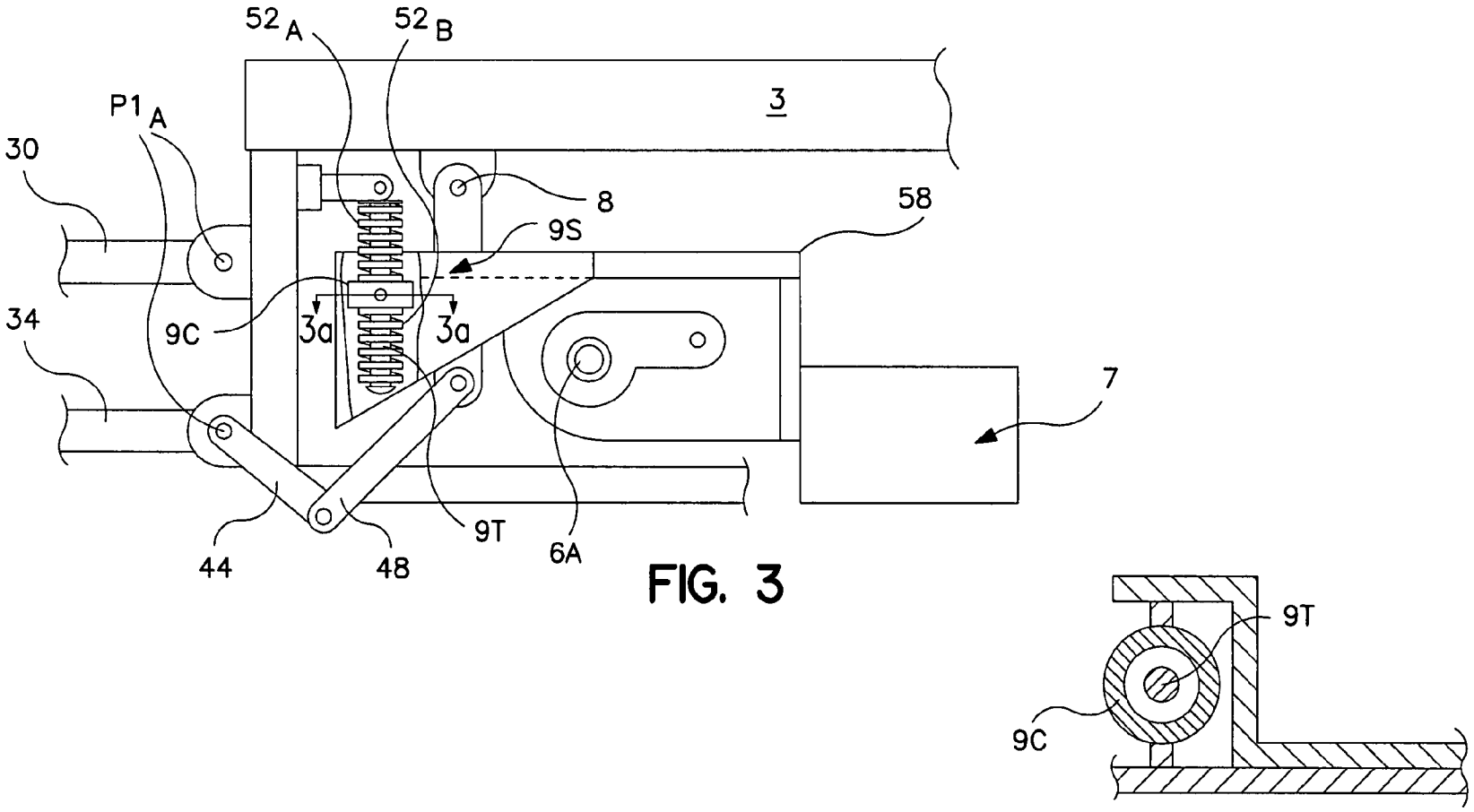
FIG. 3 shows an enlarged, partially broken-away view of a suspension assembly seen in FIG. 2.
FIG. 3*a* shows a cross-sectional view taken substantially along line 3*a*-3*a* of FIG. 3.

As shown in FIGS. 2 and 3, the lower link 34 defines a first crank arm of a crank link 40 pivotally mounted to the suspension arm 24. The first pivot axis $P\mathbf{1}_A$ forms a fulcrum about which the crank link 40 is pivotally mounted to the main structural frame 3. A second crank arm 44 of the crank link 40 defines an angle relative to the first crank arm 34, and extends downwards from the fulcrum $P\mathbf{1}_A$. To transfer or convey the bi-directional motion of the drive train assembly 7 to the links 34, 40, a third link 48 is pivotally mounted to a bracket 52 which is rigidly affixed to the drive train assembly 7. The third link 48 is pivotally mounted to the second crank arm 44 of the bell crank 40.

The drive train assembly 7 and anti-tip system 20 are biased to a predetermined "rest" position by the suspension assembly 9 best seen in FIGS. 3 and 3*a*. As shown in FIG. 2, in the rest position the anti-tip wheel 16 is close to the ground plane $G_P$ and, in the preferred embodiment, is in contact with the ground plane $G_P$. As shown in the drawings, the suspension assembly 9 comprises a bi-directional strut 9S pivotally mounted to the main structural frame 3 and to the drive train assembly 7. More specifically, the strut includes a central collar 9C, an elongate tension member 9T that passes through the collar 9C but is not attached to the collar, and spring elements 52*a*, 52*b* disposed on each side of the collar 9C.

The central collar 9C is pivotally mounted to a bracket on the drive train assembly 7. The upper end of the tension member 9T is pivotally mounted via a clevis attachment to the main structural frame 3. The spring elements 52*a*, 52*b* are compression coil springs that envelop the tension member 9T and are tied to the collar 9C at one end of the coil springs, and to respective ends of the tension member 9T at the other. Consequently, the tension member 9T can translate up and down within the spring elements 52*a*, 52*b* and the central collar 9C (best seen in FIG. 3*a*). The spring elements 52*a*, 52*b*, are preloaded in compression, opposing each other.

Figure 4:
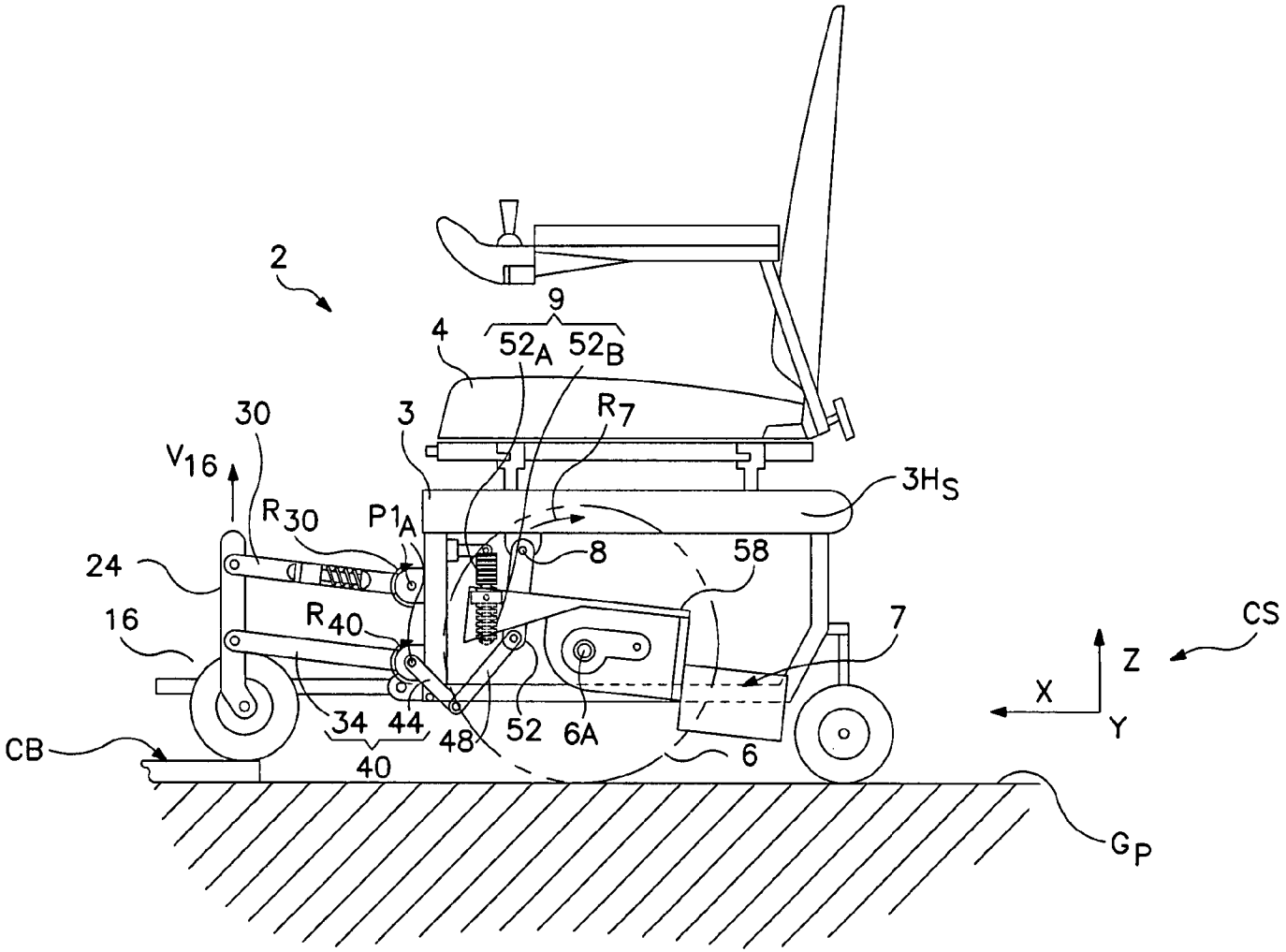
FIG. 4 shows a side view of the powered wheelchair shown in FIG. 2, wherein a pair of parallel links are depicted pivoting upwardly to raise/lift an anti-tip wheel as it climbs a curb or obstacle.

Referring now to FIG. 4, in a curb climbing operational mode, increased torque is applied by the drive train assembly 7 to the drive wheels 6 as the wheelchair 2 encounters a curb or obstacle CB. In this mode, the torque applied to the drive wheels 6 causes the drive train assembly 7 to rotate in a clockwise direction as seen in FIG. 4, in the direction of arrow $R_7$, about pivot point 8. (The clockwise and counterclockwise rotational directions described herein are in relation to a view from the left side of a wheelchair occupant. Thus, the "clockwise" rotation just described causes the rear end of the drive train assembly 7 to sink, the front end to rise and the middle, below the pivot mount 8, to move forward.) The motion of the drive train assembly 7 opposes the spring force of the upper spring element 52*a* of the suspension assembly 9, further compressing the upper spring element, while the preloaded lower spring element 52*b* is relaxed by the same motion.

The bracket 52, which is mounted to the drive train assembly 7, also rotates in the clockwise direction. The bracket 52 extends downwardly away from the pivot axis 8, so it moves forward, and thus pushes forward the third link 48, and the bottom end of the second arm 44 of the crank link 40. The movement of the second crank arm 44 causes the crank link 40 to rotate in the same clockwise direction, as shown by arrow $R_{40}$. The clockwise rotation of the crank link 40 causes the first crank arm, which is the lower link 34, to rotate upwardly. The upward movement of the lower link 34 displaces the suspension arm 24 upwards which causes the upper link 30 to rotate clockwise about its pivot $P1_A$, as shown by the arrow $R_{30}$. This motion is conveyed by the upward displacement of the suspension arm 24.

In the operating mode shown in FIGS. 2 and 4, the links 30, 34 are equal in length such that the suspension arm 24 translates in a substantially vertical direction, parallel to the frame support $3V_S$ on which the pivots $P1_A$ are mounted, and remains vertically oriented as the links 30, 34 pivot. Hence, the links 30, 34, the suspension arm 24 and the vertical main frame support $3V_S$ form a parallelogram, which remains a parallelogram as the links 30, 34 pivot between a lowermost and an uppermost vertical position. Furthermore, the suspension arm 24 remains vertically oriented while lifting/raising the anti-tip wheel 16 along arrow $V_{16}$. As shown in FIG. 4, the anti-tip wheel 16 is raised sufficiently to clear the curb or obstacle CB and the wheelchair 2 continues forward until the main drive wheels 6 contact, and ride up and over, the curb CB.

Figure 5:
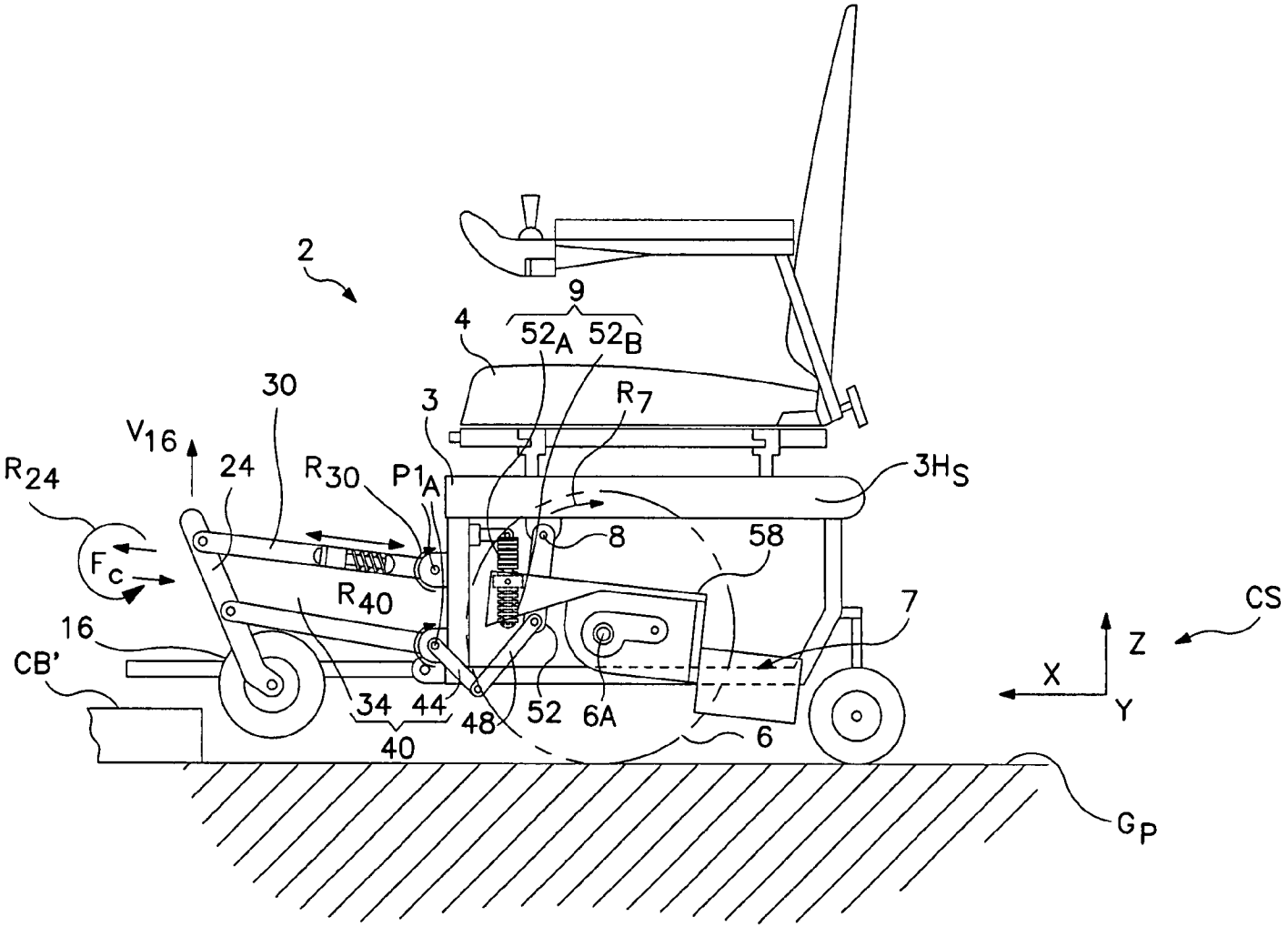
FIG. 5 shows a side view of the powered wheelchair shown in FIG. 2, wherein an upper link extends to permit the anti-tip wheel to displace inwardly upon contacting a curb or obstacle.

As shown in FIG. 5, the vertical height of a curb CB' may exceed the height attainable by the anti-tip wheel 16. As the anti-tip wheel 16 approaches and contacts the curb CB', a force couple $F_C$ is produced, acting on the suspension arm 24, that causes the upper link 30 to extend and the suspension arm 24 to rotate in a counter clockwise direction (i.e., in the direction of arrow $R_{24}$) about the pivot $P2_A$ at which the suspension arm is attached to the lower link 34. As the suspension arm 24 rotates, the anti-tip wheel 16 displaces upward and rearward toward the main frame assembly 3 or respective drive wheel 6. To further augment the rearward displacement of the anti-tip wheel 16, it is preferable to initially orient the links 30, 34 in a horizontal plane, parallel to the ground plane $G_P$.

Figure 6:
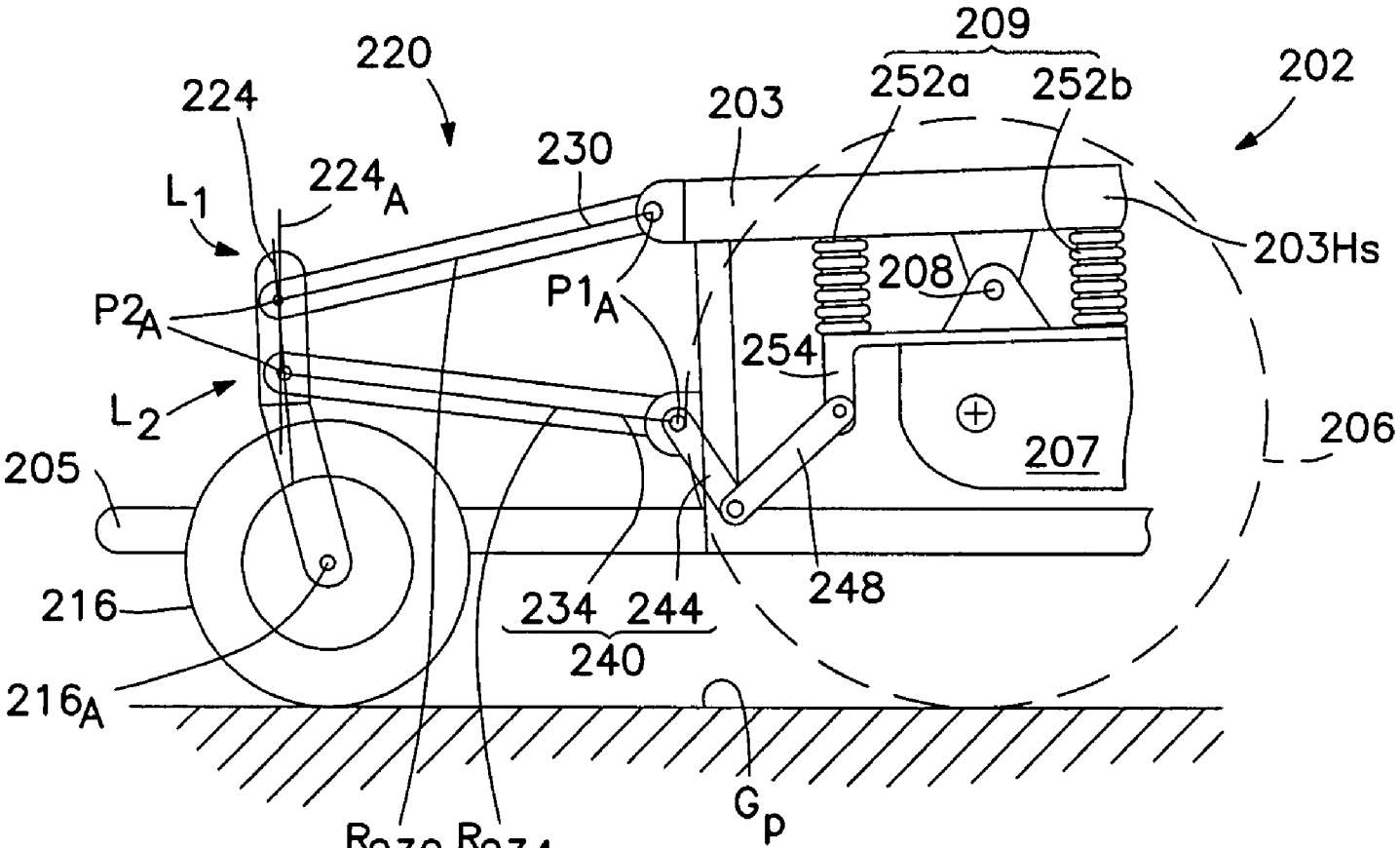
FIG. 6 is a somewhat schematic partial side view of a second embodiment of a powered wheelchair having one of its drive-wheels removed, showing an anti-tip system according to a second embodiment of the present invention.
Figure 7:
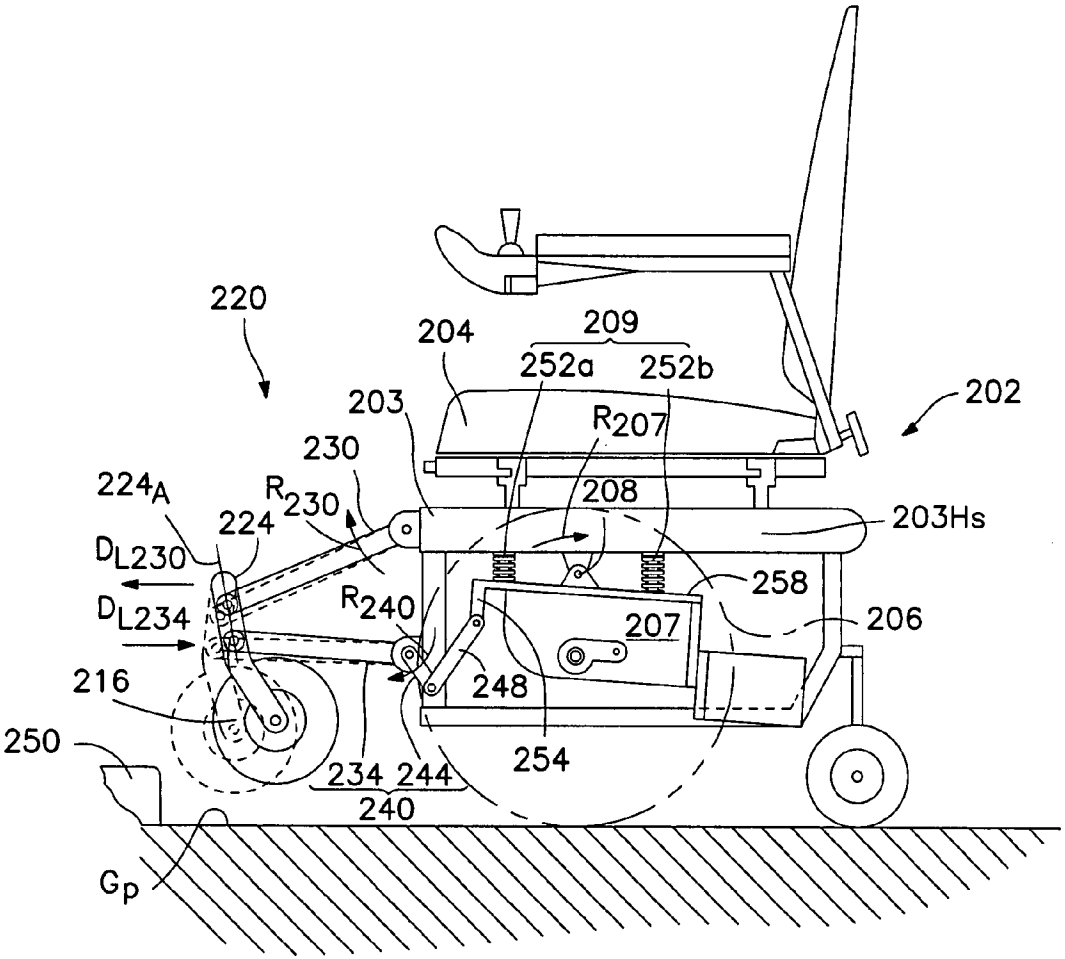
FIG. 7 is a side view of the wheelchair shown in FIG. 6, illustrating upward and rearward motion of the anti-tip wheel when the wheelchair climbs a curb and/or other obstacle.
Figure 8:
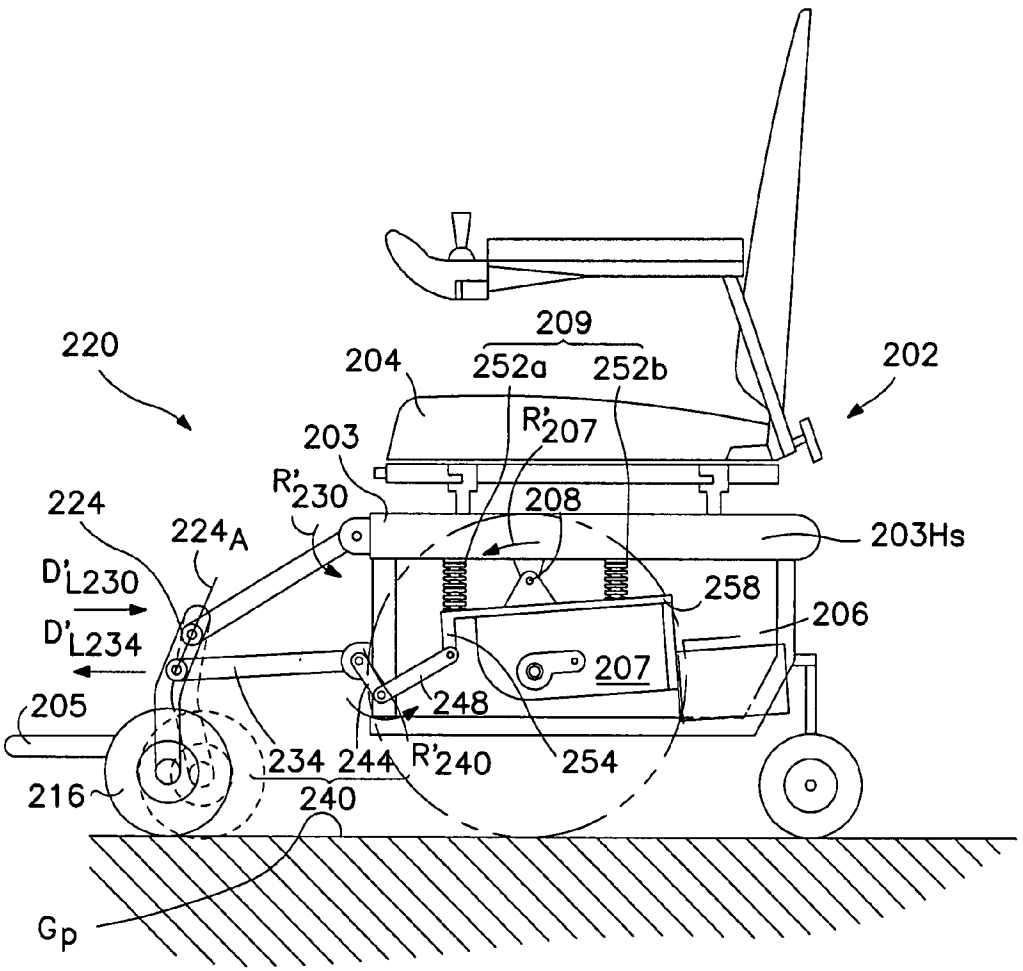
FIG. 8 is a side view similar to FIG. 7 illustrating downward and forward motion of the anti-tip wheel as the wheelchair pitches forward upon braking and/or deceleration.

Referring now to FIGS. 6 to 8, a second embodiment of a powered wheelchair indicated generally by the reference numeral 202 includes an active anti-tip system 220 according to a second embodiment of the present invention. The wheelchair 202 shown in FIGS. 6 to 8 includes a main structural frame 203, a seat 204 (see FIGS. 7 and 8) for supporting a wheelchair occupant (not shown), a footrest assembly 205 for supporting the feet and legs (also not shown) of the occupant while operating the wheelchair 202, and a pair a drive wheels 206 (shown schematically in the drawings) each being independently controlled and driven by a drive train assembly 207. Each drive train assembly 207 is pivotally mounted to the main structural frame 203 about a pivot point 208 for relative rotation between the frame and each drive assembly in response to positive or negative acceleration of the wheelchair 202. A suspension assembly 209 is provided for biasing the anti-tip system 220 to a predetermined operating position.

The anti-tip system 220 shown in FIGS. 6 to 8 includes a suspension arm 224 having a longitudinal axis $224_A$ which is substantially vertical relative to a ground plane $G_P$. The suspension arm 224 mounts an anti-tip wheel 216 for rotation about a rotational axis $216_A$. The anti-tip wheel 216 may be castered to facilitate heading or directional changes. Alternatively, the axis $216_A$ of the wheel 216 may be fixed relative to the suspension arm 224, as shown in FIGS. 6 to 8, to simplify the anti-tip system design and provide greater design flexibility when incorporating a footrest assembly.

A pair of links 230, 234 are pivotally mounted to the wheelchair main frame 203 and to the vertical suspension arm 224. Each of the links 230, 234 is pivotally mounted about a respective first pivot axis $P2_A$ to the main structural frame 203 and is pivotally mounted about a respective second pivot axis $P2_A$ to the suspension arm 224. The length $R_{230}$, $R_{234}$ of each of the links 230, 234 is the arc radius $R_L$ for motion of the respective second pivot axis $P2_A$ as the link rotates about the respective first pivot axis $P2_A$. The length $R_L$ of one of the links 230, 234 may be greater than the length $R_L$ of the other. Furthermore, at least one of the links 230, 234 is caused to rotate in response to torque applied by the drive train assembly 207. That is, a mechanism is provided to transfer the bi-directional rotary motion of the drive train assembly 207 to one of the links 230, 234.

Depending upon the orientation and length of each of the links 230, 234, the linkage arrangement of the anti-tip system 220 causes the anti-tip wheel 216 to translate vertically, in the ±Z direction, and/or longitudinally, in the forward and aft or ±X direction. The advantages of such arrangement will be discussed in greater detail hereinafter, however, it should be appreciated that the anti-tip wheel 216 may "kneel" rearwardly or "step" forwardly to change the orientation or angle with which the wheel 216 addresses an obstacle or is positioned relative to the ground plane $G_P$. The anti-tip system 220 introduces another displacement variable, the ability to displace the anti-tip wheel 216 longitudinally, to overcome obstacles or provide pitch stabilization.

As shown in FIG. 6, in a "rest" position of the wheelchair 202, standing on level ground, the anti-tip wheel 216 is close to the ground plane $G_P$ and, in the preferred embodiment, is in contact with the ground plane $G_P$. In the rest position of the wheelchair 202 shown in FIG. 6, the first pivot axis $P2_A$ of the upper link 230 is approximately vertically above the first pivot axis $P2_A$ of the lower link 234. The links 230, 234 are generally parallel, i.e., within about twenty degrees or less, with respect to one another. The lower link 234 is approximately horizontal, and the upper link 230 slopes down towards the suspension arm 224. The links 230 and 234 connect to the suspension arm 224 at respective positions $L_1$, $L_2$ along the longitudinal axis $224_A$ thereof, corresponding to the second pivot axes $P2_A$. The positions $L_1$, $L_2$ are closer together than the two first pivot axes $P2_A$. Other arrangements are possible. The spacing between the positions $L_1$ and $L_2$, the spacing between the first pivot axes $P2_A$, and the respective radius lengths $R_{230}$, $R_{234}$ of the links 230, 234, will determine the angular displacement of the suspension arm 224 as the links 230, 234 move up and down and, consequently, the magnitude of the longitudinal displacement of the anti-tip wheel 216. Preferably, the length $R_{230}$ of the upper link 230 is greater than the length $R_{234}$ of the lower link 234. The reason for this, and the effects of some possible variations in the geometry of the links, are explained below.

As shown in FIGS. 6 to 8, the lower link 234 is a first crank arm of a crank link 240 that has a fulcrum mounted about the first pivot axis $P2_A$ to the main structural frame 203. A second crank arm 244 extends downward from the fulcrum and defines an obtuse angle $\phi$ relative to the first crank arm 234. To transfer or convey rotational motion of the drive train assembly 207 to the crank link 240, a third link 248 is pivotally mounted to a bracket 254 which is rigidly affixed to the drive train assembly 207 and is pivotally mounted to the second crank arm 244 of the crank link 240.

As shown in FIG. 6, the drive train assembly 207 and anti-tip system 220 are biased to the "rest" position by the suspension assembly 209. The suspension assembly 209 comprises a pair of suspension springs 252*a*, 252*b*. One spring 252*a* is disposed forward of the drive train pivot mount 208. The other spring 252*b* is disposed rearward of the drive train pivot mount 208. Each of the suspension springs 252*a*, 252*b* is interposed between an upper horizontal frame support 203$H_S$ of the main structural frame 203 and an upper plate 258 of the drive train assembly 207. Both springs 252*a*, 252*b* are preloaded in compression, and their moments about the pivot mount 208 oppose each other. In the rest position, the forces acting on the drive train assembly 207, including the spring forces of the springs 252*a*, 252*b*, are in equilibrium.

Referring to FIG. 7, in a curb climbing operational mode, increased torque is applied by the drive train assembly 207 to the drive wheels 206 as the wheelchair 202 encounters a curb or obstacle 250. In this mode, the torque applied to the drive wheels 206 causes the drive train assembly 207 to rotate in a clockwise direction as seen in FIG. 7, in the direction of arrow $R_{207}$ in FIG. 7, about pivot point 208. (The clockwise and counter-clockwise rotational directions described herein are in relation to a view from the left side of a wheelchair occupant. Thus, the "clockwise" rotation just described causes the rear end of the drive train assembly 207 to sink, the front end to rise and the middle, below the pivot mount 208, to move forward.) The motion of the drive train assembly 207 opposes the spring force of the front spring element 252*a*, further compressing the front spring element, while the preloaded rear spring element 252*b* is relaxed by the same motion.

The bracket 252, which is mounted to the drive train assembly 207, also rotates in the clockwise direction. The bracket 252 extends downwardly away from the pivot axis 208, so it moves forwards, and thus pushes forwards the third link 248, and the bottom end of the second arm 244 of the crank link 240. The movement of the second crank arm 244 causes the crank link 240 to rotate in the same clockwise direction, as shown by arrow $R_{240}$ in FIG. 7. The clockwise rotation of the crank link 240 causes the first crank arm, which is the lower link 234, to rotate upwardly. The upward movement of the lower link 234 displaces the suspension arm 224 upwards which causes the upper link 230 to rotate clockwise about its pivot P2$_A$, as shown by the arrow $R_{230}$. This motion is conveyed by the upward displacement of the suspension arm 224.

The clockwise rotation of the lower link 234, upwards from the horizontal, causes the pivot point $L_2$ to move rearwardly in the direction of arrow $D_{L234}$ in FIG. 7 toward the main structural frame 203. The clockwise rotation of the upper link 230, upwards towards the horizontal, causes the pivot point $L_1$ to move forwardly in the direction of arrow $D_{L230}$ away from the main structural frame 203. Consequently, the suspension arm 224 rotates in a counterclockwise direction about a center between the pivot positions $L_1$ and $L_2$, and the anti-tip wheel swings 216 rearwardly and upwardly on the lower end of the suspension arm 224. Those skilled in the art will see that different lengths and/or different initial orientations between the four pivot points P2$_A$, $L_1$, and $L_2$ will cause different motions of the suspension arm 224 ands the anti tip wheel 216 as the crank link 40 rotates.

The inward or rearward motion of the anti-tip wheel 216 enhances the curb-climbing ability of the anti-tip system 220 and of the wheelchair 202. That is, in addition to upward displacement, the linkage arrangement causes the anti-tip wheel 216 to displace rearwardly (i.e., to "kneel"), thereby changing the angle with which the wheel 216 addresses or impacts an object or curb 250. While prior art anti-tip systems tend to cause the anti-tip wheel 216 to move forwardly as it moves upwardly, the present invention produces an opposite effect by taking advantage of a four-bar linkage having links that are of different radii and that describe non-similar arcuate paths.

Referring to FIG. 8, in an operational mode reversing the applied torque, such as will occur during braking or deceleration, the links 230, 234, 248 and suspension arm 224 move and rotate in directions opposite to those described with reference to FIG. 7 to displace the anti-tip wheel 216 forwardly thereby increasing the moment arm between the wheelchair center of mass and the contact point of the wheel 216. By increasing the moment arm, the force that is required to be provided by the torque of the drive train assembly to achieve a given pitch stabilizing effect is decreased. Alternatively, a greater pitch stabilization effect can be achieved for the same force when the moment arm is increased. Consequently, the four bar linkage arrangement of the anti-tip system 220 provides, or offers the opportunity to provide, improved pitch stabilization characteristics.

The anti-tip system 220 provides an advantageous geometric relationship to enhance the curb and/or obstacle climbing ability of an anti-tip system 220. That is, a four-bar linkage arrangement is employed to cause the anti-tip wheel 216 to displace longitudinally aft for curb-climbing, or longitudinally forward for pitch stabilization. The variation in longitudinal position causes the wheel 216 to address a curb or contact a ground plane $G_P$ at a different angle or position to augment the curb-climbing or pitch stabilizing effect of the active anti-tip system 220.

While it is readily apparent how the upward travel of the anti-tip wheel 16, 216 as the link 34, 234 is raised can improve or expand the operational envelope for curb-climbing, the advantages provided by the inward or rearward displacement of the anti-tip wheel as the suspension arm 24, 224 rotates are more subtle. Referring again to FIGS. 5 and 7, in the rest position the anti-tip wheel 16, 216 is approximately directly below the pivot $L_2$, so the angular motion of the suspension arm 24, 224 shown in FIGS. 5 and 7 increases the vertical distance from the anti-tip wheel 16, 216 to the curb CB', 250 or ground plane $G_P$, thereby providing greater ground clearance. Furthermore, inward displacement of the anti-tip wheel changes the angle at which the curb contacts or addresses the anti-tip wheel 16, 216, and a more favorable contact angle can produce a vertical force component $V_C$ capable of pitching the front end of the wheelchair 2 upwardly, over the curb CB', 250. Inward displacement of the anti-tip wheel 16, 216 shortens the distance between the curb CB', 250 and the main drive wheels 6, 206, so that the main drive wheels can engage the curb before the wheelchair 2, 202 beings to lose its forward momentum.

In addition to the upward component of motion as the suspension arm rotates as shown in FIG. 5, the vertical displacement of the anti-tip wheel 16, 216 in FIGS. 4 and 7, is a function of the rotational motion of the drive train assembly 7, 207 and the geometry, that is to say, the relative lengths and positions, of the links 30, 34, 48, 230, 234, 248. In FIG. 7, the longitudinal displacement of the anti-tip wheel 216 is primarily a function of the difference in length between the first and second links 230, 234, of the difference between the separation of the pivots P1$_A$ and the separation of the pivots P2$_A$, and of the distance from the lower pivot $L_2$ to the anti-tip wheel axis 16$_A$. Those skilled in the art will understand how that geometry can be adjusted to produce a preferred motion of the anti-tip wheel 16, 216.

In FIG. 5, the principal longitudinal displacement of the anti-tip wheel 16 is independent of the vertical displacement of the pivot P2$_A$ at which the suspension arm 24 is attached to the lower link 34. Full rearward displacement of the anti-tip wheel 16 can be achieved without any pivot motion of the lower link 34. Therefore, the anti-tip wheel 16 can achieve a more favorable contact angle, as shown in FIG. 5, without requiring large torque inputs to the main drive wheels 6 to rotate the drive train assembly 7 as shown in FIG. 7.

The pivoting motion of the links 30, 34 upwards from the horizontal resting position as shown in FIG. 4 produces a small additional aft displacement that can enhance the curb climbing capability of the anti-tip system as discussed above.

In summary, the anti-tip system 20, 202 of the present invention provides an advantageous geometric relationship to enhance the curb and/or obstacle climbing ability of an anti-tip system. That is, the anti-tip system 20, 220 employs an adaptable linkage arrangement having pivotable links for lifting/raising the anti-tip wheel in a vertical direction and, in a first embodiment of the invention, at least one variable length link for facilitating angular displacement of a suspension arm and inward displacement of the anti-tip wheel.

While the anti-tip system 20, 220 has been described in terms of an embodiment which best exemplifies the anticipated use and application thereof, other embodiments are contemplated which also fall within the scope and spirit of the invention. For example, while the anti-tip system 20, 220 has been described in the context of an active anti-tip system for a powered wheelchair, the anti-tip linkage arrangement 20 is also applicable to passive anti-tip systems. That is, in a passive anti-tip system, the links 30, 34 are not coupled to the drive train assembly 7, but are spring-biased by the suspension system to a predetermined operating position, for example, resting on the ground plane $G_P$. Such a passive system provides pitch stabilization, but is more limited in its ability to traverse obstacles. That is, contact with an obstacle effects vertical displacement in such a passive system whereas the bi-directional pivot motion of the drive train assembly effects vertical displacement in the active system of the preferred embodiment.

In the interests of clarity, the variable-length link 30 has been described in one embodiment, see especially FIG. 5, while links 230, 234 that are not parallel and/or are of different lengths have been described in another embodiment, see especially FIGS. 7 and 8. One skilled in the art will understand from the present description how links that are not parallel and/or are of different lengths, and at least one of which is also of variable length, may be combined in a single anti-tip mechanism, and will understand from the present description the advantages and disadvantages of such a combination.

Further, while the anti-tip system 20, 220 has been illustrated and described in terms of a forward anti-tip system, taking the "front" as the direction in which a user sitting in the seat 4, 204 faces and towards which the wheelchair principally moves, the anti-tip system is equally applicable to a system which stabilizes a rearward or aft tipping motion of a wheelchair. Furthermore, the specific embodiments show the anti-tip wheel 16, 216 as being in contact with the ground plane in the rest position. However, the anti-tip wheel 16, 216 may be normally in or out of ground contact, depending in part upon whether a fixed-axis or castored anti-tip wheel is employed.

While a bracket 52, 252, a crank arm 44, 244 and third link 48, 248 are shown in the drawings for conveying the bi-directional motion of the drive train assembly 7, 207 to the parallel links 30, 34, 230, 234, any of a variety of motion conveying devices may be employed. Moreover, while the adaptable anti-tip system 20 in the embodiment shown in FIGS. 2 to 5 employs an extensible upper link 30, either link 30, 34 may be extensible or retractable. For example, the anti-tip system 20 may employ a telescoping, retractable lower link 34 to enable rotation of the suspension arm 24 as a curb CB' engages the anti-tip wheel 16. Furthermore, while the extensible link 30 includes a spring-biased tension rod 36 for coupling first and second link segments $\mathbf{30}_A$, $\mathbf{30}_B$, other arrangements may be used. For example, the link segments may be tubular and co-axial and may then employ an internal spring member for telescopically extending or retracting.

Moreover, while the drive train assembly 207 is shown in FIGS. 6 to 8 to employ an angled or L-shaped bracket 254 for connecting to the third link 248, a bracket having a substantially linear configuration may be employed. The bracket may also connect to a lower portion of the drive train assembly, and projects longitudinally in a forward direction.

While the suspension 9 shown in FIGS. 2 to 5 employs a bi-directional strut 9S, and the suspension 209 shown in FIGS. 6 to 8 employs a pair of suspension springs disposed on opposite sides of the drive train pivot mount 8, other suspension options are contemplated. For example, the wheelchair 2 shown in FIGS. 2 to 5 could employ the suspension 209, and the wheelchair 202 shown in FIGS. 6 to 8 could employ the suspension 9. Also, single spring suspensions may be incorporated into any of the designs.

Further, a variety of other modifications to the embodiments will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A power wheelchair comprising:

a body;

a drive wheel;

a motor arranged to drive the drive wheel;

a suspension element bearing the drive wheel and arranged to pitch relative to the body in response to acceleration of the drive wheel by the motor;

a pair of anti-tip links pivoted to the body;

a suspension arm pivoted to the pair of anti-tip links;

an anti tip wheel rotatably mounted on the suspension arm; and an actuator in operative pivotal connection with the suspension element and at least one of the anti-tip links, the actuator responsive to motion of the suspension element relative to the body so as to cause pivoting of the anti-tip links relative to the body.

2. A wheelchair according to claim 1, wherein the actuator comprises a third link pivotally connected to the suspension element at one end of the third link and pivotally connected to the at least one anti-tip link at the opposite end of the third link.

3. The wheelchair according to claim 1, wherein said anti-tip wheel is at a first end of the wheelchair, and said actuator is so arranged that movement of said suspension element in response to acceleration of the wheelchair towards said first end moves said anti-tip links in a sense to raise the suspension arm and the anti-tip wheel.

4. The wheelchair according to claim 3, wherein the first end of the wheelchair is the front in a principal direction of motion of the wheelchair.

5. The wheelchair according to claim 1, wherein said suspension element comprises a transmission through which said motor drives said drive wheel.

6. The wheelchair according to claim 1, wherein at least one of said anti-tip links is variable in length, said variable length link extending or retracting to facilitate angular displacement of said suspension arm and displacement of said anti-tip wheel in a longitudinal direction of the wheelchair.

7. The wheelchair according to claim 6, wherein said variable length link is arranged to permit longitudinal displacement of said anti-tip wheel in response to an externally applied force on said anti-tip wheel.

8. The wheelchair according to claim 7, wherein said variable length link and said anti-tip wheel have a rest position, wherein said variable length link is arranged to change length away from said rest position to permit said longitudinal displacement of said anti-tip wheel in response to an externally applied force on said anti-tip wheel, and wherein said variable length link and said anti-tip wheel are arranged to return to said rest position when said externally applied force is removed.

9. The wheelchair according to claim 8, wherein said longitudinal displacement is permitted in a longitudinal direction toward said body.

10. The wheelchair according to claim 9, wherein said longitudinal displacement toward said body is accompanied by upward displacement of said anti-tip wheel.

11. The wheelchair according to claim 8, wherein said rest position is an end position of the change of length of said variable length link.

12. The wheelchair according to claim 8, further comprising a spring arranged to return said variable length link and said anti-tip wheel to said rest position.

13. The wheelchair according to claim 6 wherein said pair of anti-tip links includes an upper link and a lower link, said upper link being extensible and said lower link having a fixed length, said suspension arm rotating about its point of pivoting to said lower link to effect longitudinal displacement of said anti-tip wheel.

14. The wheelchair according to claim 1, wherein the positions at which said anti-tip links are pivoted to said body and to said suspension arm are arranged such that as said suspension arm rises relative to said body said suspension arm rotates relative to said body, and a lower end of said suspension arm bearing said anti-tip wheel moves towards said body.

15. The wheelchair according to claim 14, wherein an upper one of said anti-tip links is longer than a lower one of said anti-tip links.

16. The wheelchair according to claim 14, wherein the positions at which said anti-tip links are pivoted to said body are closer together than the positions at which said anti-tip links are pivoted to said suspension arm.

17. The wheelchair according to claim 1, wherein one of the anti-tip links is a crank link having a fulcrum where it is pivoted to the body, a first arm extending from the fulcrum to the suspension arm, and a second arm extending from the fulcrum, the actuator acting on the second arm.

18. The wheelchair according to claim 17, wherein the second arm of the crank link extends down from the fulcrum.

19. The wheelchair according to claim 18, wherein the actuator is a third link pivotally connected to the suspension element at a position relatively below the pivotal connection between the suspension element and the body and is pivotally connected to the second arm of the crank link.

20. The wheelchair according to claim 1, which is a mid-wheel drive wheelchair having at each side a drive wheel with a respective suspension element, pair of anti-tip links, suspension arm, anti-tip wheel, and actuator operatively connected therewith.

21. A power wheelchair comprising:

a body;

a drive wheel;

a motor arranged to drive the drive wheel;

a suspension element bearing the motor and arranged to pitch relative to the body in response to the torque applied to the drive wheel by the motor;

a pair of anti-tip links pivoted to the body;

a suspension arm pivoted to the pair of anti-tip links;

an anti-tip wheel rotatably mounted on the suspension arm; and an actuator in operative connection with the suspension element and one of the anti-tip links, the actuator responsive to motion of the suspension element relative to the body so as to cause pivoting of the anti-tip links relative to the body;

wherein one of the anti-tip links is a crank link having a fulcrum formed at the position where the link is pivoted to the body, a first arm extending from the fulcrum to the suspension arm, and a second arm extending from the fulcrum in an opposite sense from the first arm, the actuator acting on the second arm; and wherein the crank link is a lower one of the pair of anti-tip links.

22. A powered wheelchair comprising:

a main structural frame;

a drive train assembly, said drive train assembly pivotally mounting to the main structural frame and pivotable relative to said frame when applying torque to at least one drive wheel;

a bracket fixed to said drive train assembly; and an anti-tip system comprising at least one anti-tip wheel;

a suspension arm for mounting said anti-tip wheel; and a pair of links, each of said links pivotally mounting to said main structural frame at one end of the link and pivotally mounting to said suspension arm at the other end of the link, at least one of said links coupled to said drive train assembly such that said pair of links pivot in response to rotation of said drive train assembly; and an actuator in operative pivotal connection with the bracket at one end and in operative pivotal connection at its opposite end with one of the pair of links, the bracket translating the motion of the drive train assembly relative to the frame, through the actuator, to cause a pivoting of the anti-tip links relative to the frame.

23. The powered wheelchair of claim 22, wherein said anti-tip system is mounted at one end of said main structural frame.

24. The powered wheelchair of claim 23, wherein said anti-tip system is mounted at a front end of the frame with respect to normal use of said powered wheelchair.

25. The powered wheelchair of claim 22, wherein at least one link is variable in length and said anti-tip wheel is mounted at a lower end of said suspension arm, such that said anti-tip wheel moves towards or away from said frame as said variable-length link varies in length.

26. The powered wheelchair of claim 25, wherein said anti-tip wheel moves towards or away from said frame in response to an externally applied force on said anti-tip wheel.

27. The powered wheelchair of claim 26, wherein said anti-tip wheel is arranged to move inwardly toward said main structural frame away from a rest position.

28. The powered wheelchair of claim 27, wherein said anti-tip wheel moves upwardly as it moves inwardly.

29. The powered wheelchair of claim 25, wherein said variable length link includes first and second link segments relatively movable with respect to one another for varying said length dimension.

30. The powered wheelchair according to claim 22, wherein the operative coupling of said drive train assembly to the link, through the actuator, is in response to movement of said drive train assembly when torque is applied to the drive wheels.

31. The powered wheelchair according to claim 22, further comprising a third link, the third link pivotally connected to the bracket and the actuator such that movement of the drive train assembly in response to torque applied by the drive train assembly to the drive wheel is transmitted through the third link to cause pivoting of the anti-tip links in a sense to raise the suspension arm and the anti-tip wheel.

32. The powered wheelchair according to claim 22 wherein a lower link of said pair of links is a crank link.

33. The powered wheelchair according to claim 32, wherein the crank link has a fulcrum, a first crank arm and a second crank arm, said fulcrum pivotally mounting about a first pivot axis to said main structural frame, said first crank arm linked to said drive train assembly, and said second crank arm pivotally mounting about a second pivot axis to said suspension arm.

34. A powered wheelchair comprising:

a main structural frame;

a drive train assembly, said drive train assembly pivotally mounting to the main structural frame and pivotable relative to said frame when applying torque to at least one drive wheel; and an anti-tip system comprising:

at least one anti-tip wheel;

a suspension arm for mounting said anti-tip wheel; and a pair of links, each of said links pivotally mounting to said main structural frame at one end of the link and pivotally mounting to said suspension arm at the other end of the link, at least one of said links coupled to said drive train assembly such that said pair of links pivot in response to rotation of said drive train assembly, at least one of said links being variable in length such that said suspension arm rotates and said anti-tip wheel moves relative to said frame as said variable-length link varies in length; and wherein said pair of links includes an upper and lower link, said upper link being extensible and said lower link having a fixed length, said suspension arm rotating about said point of pivoting of said suspension arm to said lower link to effect displacement of said anti-tip wheel towards said frame as said upper link extends.

35. A powered wheelchair comprising:

a main structural frame;

a drive train assembly, said drive train assembly pivotally mounting to the main structural frame and pivotable relative to said frame when applying torque to at least one drive wheel; and an anti-tip system comprising at least one anti-tip wheel, a suspension arm for mounting said anti-tip wheel, and a pair of links, each of said links pivotally mounting to said main structural frame at one end of the link and pivotally mounting to said suspension arm at the other end of the link, at least one of said links coupled to said drive train assembly such that said pair of links pivot in response to rotation of said drive train assembly, at least one of said links being variable in length such that said suspension arm rotates and said anti-tip wheel moves relative to said frame as said variable-length link varies in length, wherein said variable length link comprises first and second link segments and a spring-biased tension rod connecting said segments.

36. The powered wheelchair according to claim 35, wherein said first link segment includes a rod-connecting end having a longitudinal bore for accepting and aligning said tension rod, said second link segment connected to one end of said tension rod, and a coil spring in compression disposed between said rod-connecting end of said first link segment and the other end of the tension rod.

37. A vehicle comprising:

a frame;

a pair of main drive wheels mounting to and supporting the frame about a rotational axis;

a drive train assembly pivotally mounting to the main structural frame and capable of bi-directional rotation about said pivot axis when torque is applied to the drive wheels; and an active anti-tip system including at least one anti-tip wheel;

a suspension arm for mounting said anti-tip wheel;

a pair of anti-tip links, each of said links pivotally mounted to said main structural frame at one end and pivotally mounted to said suspension arm at the other end, at least one of said links coupled to said drive train assembly such that the links pivot in response to rotation of said drive train assembly an actuator in operative pivotal connection with a suspension element and one of the anti-tip links such that movement of the suspension element in response to torque applied to the drive wheels by the drive train assembly is transmitted through the actuator to cause pivoting of the anti-tip links in a sense to raise the suspension arm and the anti-tip wheel.

38. The vehicle according to claim 37, wherein at least one of said links is variable in length, said anti-tip wheel is positioned at a lower end of said suspension arm, and changes in the length of said variable length link are associated with longitudinal displacement of said anti-tip wheel.

39. The vehicle according to claim 38, wherein said anti-tip wheel is displaceable longitudinally in response to an externally applied force on said wheel.

40. The vehicle according to claim 39, wherein said anti-tip wheel is displaceable inwardly toward said main structural frame from a rest position.

41. The vehicle according to claim 40, wherein said pair of links includes an upper link and a lower link, said upper link being extensible and said lower link having a fixed length, said suspension arm rotating about its point of connection with said lower link to effect displacement of said anti-tip wheel toward said frame as said upper link extends.

42. The vehicle according to claim 37, wherein a lower one of said pair of links is a crank link having a fulcrum, a first crank arm and a second crank arm, said fulcrum pivotally mounting said crank link about a first pivot axis to said frame, said second arm pivotally connected to said actuator.

43. A vehicle comprising:

a body;

at least one drive wheel;

a motor arranged to drive the drive wheel;

a suspension element bearing the motor and arranged to pitch relative to the body in response to the torque applied to the drive wheel by the motor;

a pair of anti-tip links pivotally mounted on the body at one end and their opposite end projecting from the body away from the drive wheel;

a suspension arm pivoted to the pair of anti-tip links;

an anti-tip wheel mounted on the suspension arm; and a third link operatively pivotally connected to the suspension element at one end thereof and to one of the anti-tip links at the opposite end thereof, the third link responsive to motion of the suspension element relative to the body so as to cause pivoting of the anti-tip links relative to the body about their pivotal mounting.

* * * * *

UNITED STATES PATENT AND TRADEMARK OFFICE

CERTIFICATE OF CORRECTION

PATENT NO. : 7,316,282 B2
APPLICATION NO. : 10/961972
DATED : January 8, 2008
INVENTOR(S) : Mulhern et al.

It is certified that error appears in the above-identified patent and that said Letters Patent is hereby corrected as shown below:

Column 12

At line 37, change "bearing the drive wheel and" to --bearing the motor and--.
At line 39, change "acceleration of the drive wheel by the motor" to --the torque applied to the drive wheel by the motor--.

Signed and Sealed this

Twelfth Day of August, 2008

JON W. DUDAS
*Director of the United States Patent and Trademark Office*